United States Patent [19]

Shino

[11] Patent Number: 5,033,675

[45] Date of Patent: Jul. 23, 1991

[54] CONNECTOR

[75] Inventor: Katsuhide Shino, Nara, Japan

[73] Assignee: Sharp Kabushiki Kaisha, Osaka, Japan

[21] Appl. No.: 455,177

[22] Filed: Dec. 22, 1989

Related U.S. Application Data

[63] Continuation of Ser. No. 107,765, Oct. 9, 1987, Pat. No. 4,927,368.

[30] Foreign Application Priority Data

Oct. 13, 1986 [JP] Japan ..... 61-156200
Nov. 10, 1986 [JP] Japan ..... 61-172440
Nov. 19, 1986 [JP] Japan ..... 61-178675

[51] Int. Cl.[5] ..... H01R 9/09

[52] U.S. Cl. ..... 439/66; 439/86; 439/91; 439/591

[58] Field of Search ..... 439/66, 82, 86, 87, 439/91, 591

[56] References Cited

U.S. PATENT DOCUMENTS

| | | | |
|---|---|---|---|
| 4,008,300 | 2/1977 | Ponn | 439/86 |
| 4,027,936 | 7/1977 | Nemoto et al. | 439/91 |
| 4,050,756 | 9/1977 | Moore | 439/91 |
| 4,408,814 | 10/1983 | Takashi et al. | 439/66 |
| 4,470,649 | 9/1984 | Spencer et al. | 439/82 |
| 4,655,517 | 4/1987 | Bryce | 439/83 |
| 4,754,546 | 5/1988 | Lee et al. | 439/86 |
| 4,927,368 | 5/1990 | Shino | 439/66 |

FOREIGN PATENT DOCUMENTS

| | | | |
|---|---|---|---|
| 2234961 | 4/1973 | Fed. Rep. of Germany | 439/66 |

*Primary Examiner*—Paula A. Bradley

[57] ABSTRACT

A rubber connector comprises a plurality of insulating portions and a plurality of conducting portions which are alternately disposed with the insulating portions and projected from adjacent insulating portions.

3 Claims, 4 Drawing Sheets

CONNECTOR

This application is a continuation of copending application Ser. No. 07/107,765, filed on Oct. 9, 1987, now Pat. No. 4,927,368.

BACKGROUND OF THE INVENTION

The present invention relates to a rubber connector in which conducting portions and insulating portions are alternately disposed with each other, and more particularly, to a rubber connector in which each of the conducting portions thereof has a projecting form.

Conventionally, as shown in FIG. 1, the rubber connector 9 is shaped in a virtually flat form in the direction of its thickness, in which insulating portions 1 and conducting portions 2 are alternately disposed with each other.

Therefore, to effect a connection of an external device with a unit having the rubber connector 9 fitted thereto, it has been necessary that they are constructed, as shown in FIG. 2. In particular, when the connection is made, the cabinet member of the unit (such as an IC card reader) 3 covering the portion at which the connector is fitted thereto may be removed to expose the whole body of the rubber connector. Also, on the side of the external device (such as a memory card and IC card) 4, a contact terminal board 5 may be exposed to the outside.

Therefore, problems arise such as the rubber connector 9 is difficult to fix in place and the unit 3 and the external device 4 are both susceptible to the influence of humidity, liable to be damaged by foreign substances, and have mechanically weak points because large portions of their contact terminals are exposed.

Incidentally, 6 and 7 in the figure denote a contact terminal and circuit board, respectively, incorporated in the unit 3, while 8 denotes a contact terminal disposed on the device 4 to be connected with the conducting portion 2 of the rubber connector 9.

In an example in which another type of conventional rubber connector is used, the rubber connector 9 in the form of a bar is inserted, as shown in FIG. 3, in an opening portion 15*a* made in the cabinet 15 of the body of a computer (such as an IC card reader) containing a circuit board 10. The rubber connector 9 has its conducting portions 2 in contact with contact terminals 11 on the circuit board 10 and with its upper side slightly protruded from the opening portion 15*a*. The external memory cabinet (such as a memory card and IC card) 14 containing on its underside a circuit board 13 having protruded contact terminals 12 thereon is adapted to come in contact with the conducting portions 2 when pressed in the direction of arrow A against the upper side of the computer body cabinet 15 to be fixed thereto. Thereby, both the circuit boards 10 and 13 are easily electrically connected with each other through the rubber connector 9 without the need for soldering.

However, since the aforementioned conventional rubber connector 9 is of the form of a bar with the insulating portions 1 and conducting portions 2 formed at the same height and it is required that rubber connector 9 as a whole protrude from the opening portion 15*a*, both the computer body cabinet 15 and the external memory cabinet 14 must be provided with openings therein extending over virtually the total widths thereof. Therefore, a problem arises concerning the strength of the cabinets at these portions.

SUMMARY OF THE INVENTION

An object of the present invention is the provision of a rubber connector in which conducting portions and insulating portions are alternately disposed with each other and each of the conducting portions thereof is in a projecting form.

Another object of the present invention is the provision of a rubber connector in which contact conducting portions are formed to project from a unit while other portions than the contact conducting portions are contained within the unit so that sealing of the connected portions may be improved.

A further object of the present invention is the provision of a rubber connector which will be highly reliable by being constructed such that the strength of the cabinet is improved and irregular deformation of the contact conducting portions at the time they are compressed is prevented, whereby imperfect contact is eliminated and durability to repeated compression is improved.

Yet another object of the present invention is the provision of a rubber connector in which contact conducting portions formed to project are covered by insulating material, so that the problem of leakage is avoided even if the connector is used for connections between two units which use metal plates at portions of their cabinet members, and so that sealing at the connected portions may be improved, and advantages in the manufacture of the arrangement may be obtained.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, a rubber connector comprises a plurality of insulating portions and a plurality of conducting portions which are disposed alternately with the insulating portions and projected from adjacent insulating portions.

The aforementioned plural conducting portions are projected from the insulating portions in a predetermined direction.

A stepped portion may be formed at the front end of a projecting conducting portion and a smaller-diametered portion whose diameter is smaller than that of the base end of the conducting portion may be formed to project therefrom.

Further, the aforementioned projecting portion of the conducting portion may be covered over its peripheral face by an insulating portion and the conducting portion may be exposed to the outside on the front end face of the projecting portion of the conducting portion.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE EMBODIMENTS

An embodiment of the present invention will now be described by the following.

Figure 1:
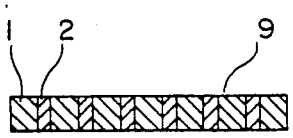
FIG. 1 PRIOR ART
FIG. 1 is a side view of a conventional rubber connector.
Figure 2:
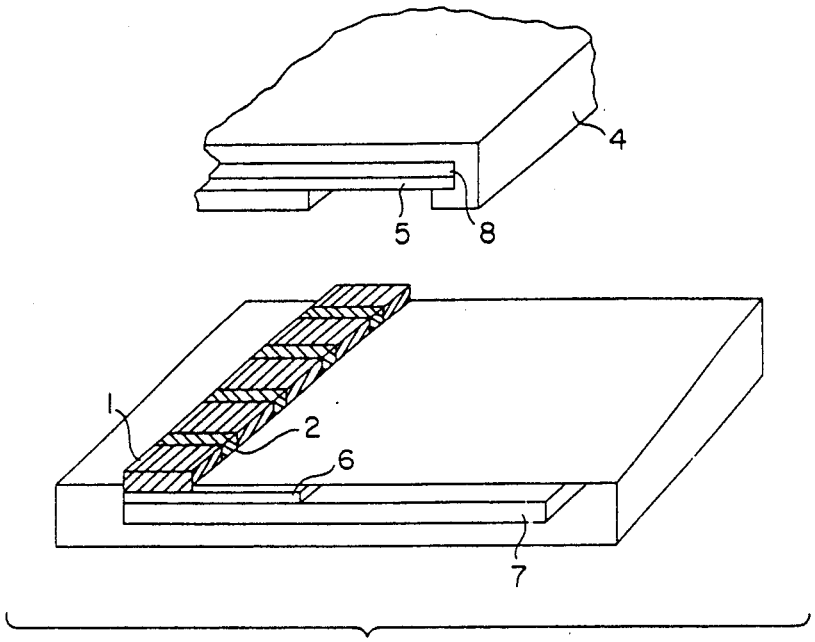
FIG. 2 PRIOR ART
FIG. 2 is a perspective view of portions to be connected of an electronic unit in which the rubber connector of FIG. 1 is incorporated.
Figure 3:
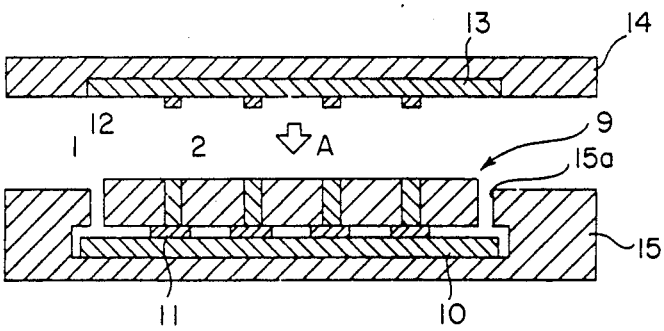
FIG. 3 PRIOR ART
FIG. 3 is a sectional view for explaining the condition under which two circuit boards are connected through the rubber connector of FIG. 1.
Figure 4:
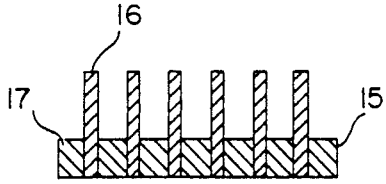
FIG. 4 is a side view of a rubber connector according to a first embodiment of the present invention.

FIG. 4 is a side view of a rubber connector according to a first embodiment of the present invention, in which a connector body 15 is structured of conducting portions 16 made, for example, of a conducting silicon rubber and insulating portions 17 made, for example, of an insulating silicon rubber alternately disposed with each other.

The conducting portion 16 is longer than the insulating portion 17 so that the conducting portion 16 sticks out. A plurality of conducting portions and insulating portions are provided.

Figure 5:
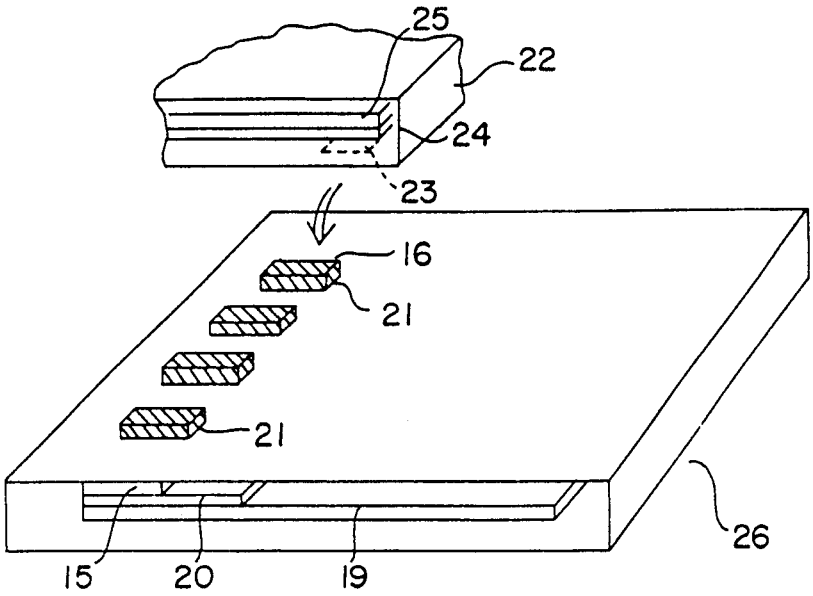
FIG. 5 is a perspective view of portions to be connected of an electronic unit in which the rubber connector of FIG. 4 is incorporated.

FIG. 5 shows a state of the aforementioned connector body 15 fitted to a data processing unit (such as an IC card reader) 26, in which reference numeral 18 denotes a cabinet member of the data processing unit 26.

As shown in the figure, contact terminals 20 are mounted on a circuit board 19 disposed within the cabinet member 18 and the contact terminals 20 are electrically connected with the connector body 15. The cabinet member 18 is provided with a plurality of holes 21, 21, . . . made therein so that the conducting portions 16 of the connector body 15 are passed through the holes 21, 21. Therefore, the conducting portions 16 are exposed to the outside of the cabinet member 18.

An external memory card (such as a memory and IC card) 22 to be electrically connected with the data processing unit 26 is provided with an opening portion 23 made therein through which the conducting portions 16 are passed. The data processing unit 26 and the external memory card 22 are then connected with each other through the rubber connector 15.

The external memory card 22 has contact terminals 24 and a circuit board 25, therein. The conducting portions 16 of the rubber connector 15 passed through the opening portion 23 are adapted to be brought into abutment with the contact terminals 24.

According to the present embodiment, since the holes 21 are made in the cabinet 18 of the unit 26 and the conducting portions 16 of the connector 15 are adapted to be passed therethrough, the connector 15 can be easily fixed in place and also satisfactorily sealed off. Reliability of the unit is greatly improved. The aforementioned effects are also obtained on the side of the external memory card 22.

Figure 6:
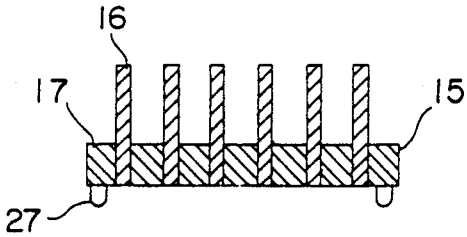
FIG. 6 is a side view of a rubber connector according to a second embodiment of the present invention.

FIG. 6 shows a rubber connector according to a second embodiment of the present invention. As shown in the figure, the connector body 15 is provided with positioning protrusions 27. Referring to the figure, conducting portions are denoted by 16 and insulating portions are denoted by 17. Corresponding to the positioning protrusions 27, holes (not shown) are made in the circuit board (such as the circuit board 19 in FIG. 5).

By the provision of the aforementioned positioning protrusions 27, positioning and fixing of the rubber connector 15 is achieved simply utilizing the holes made in the circuit board (not shown) and the mounting operation can be performed effectively.

Figure 7:
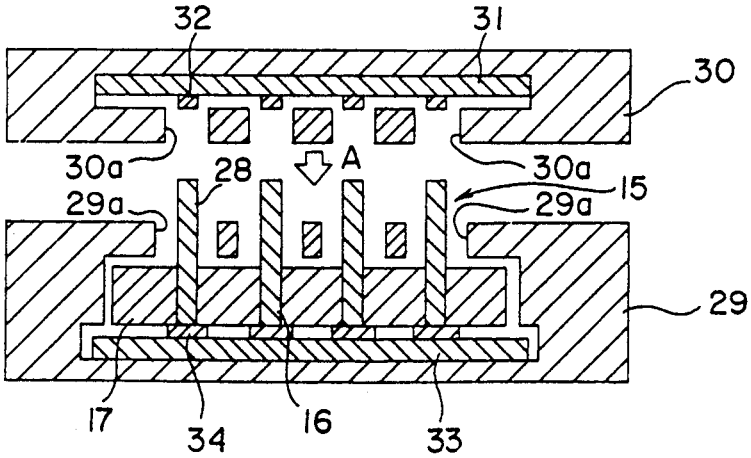
FIG. 7 is a vertical sectional view for explaining the manner in which two circuit boards are connected through the rubber connector of FIG. 4.

The aforementioned embodiment will further be described with reference to FIG. 7. The present rubber connector 15 is such that the conducting portions 16 as shown in FIG. 4 are projected from one side of the insulating portions 17 and made into projecting conducting portions 28. As shown in FIG. 7, only the projecting conducting portions 28 are allowed to stick through holes **29*a* made in the upper side of the cabinet 29 of the body of the computer (such as an IC card reader) so as to be held within the cabinet. The projecting conducting portions 28 are inserted into a plurality of holes 30*a* made in the underside of the cabinet 30 of the external memory (such as an IC card and memory card), and by having both the cabinets 29 and 30 fixed to each other, the ends of the projecting conducting portions 28 are brought into tight contact with the contact terminals 32 on the circuit board 31 within the holes 30*a*. The contact terminals 34 on the circuit board 33 and the contact terminals 32 on the circuit board 31** are electrically connected in the described manner and the strength of the cabinets is thus achieved.

According to the rubber connector of the present invention as described above, the connector can be fixed to the cabinet by virtue of the projecting conducting portions. By exposing only the conducting portions to the outside with the other parts enclosed within the unit, it may be possible to have all connected portions put in a hermetically sealed construction so that the arrangement may be made more reliable.

Now, a third embodiment of the present invention will be described in detail.

Figure 8:
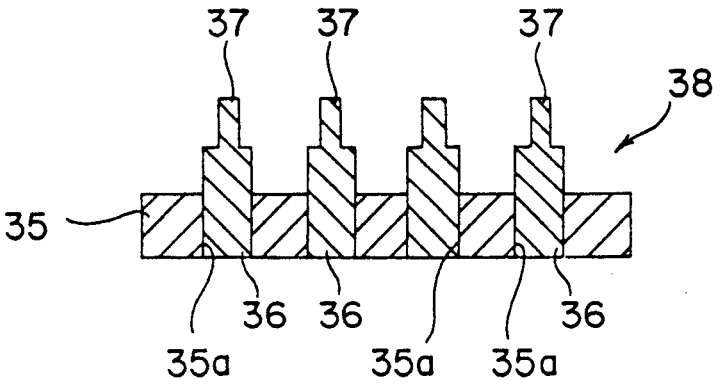
FIG. 8 is a vertical sectional view of a rubber connector of a third embodiment of the present invention.

FIG. 8 is a vertical sectional view of the structure of a rubber connector of a third embodiment of the present invention, in which 35 denotes an insulating portion formed into a pillar made of an insulating silicon rubber or the like, 36, 36, . . . denote cylindrical contact conducting portions made of a conducting silicon rubber or the like with their one ends fitted in and projected from through holes **35*a*, 35*a*, . . . made in the insulating portion 35 spaced at predetermined intervals, and 37, 37, . . . denote smaller-diameter cylindrical portions provided at the front ends of the projecting portions of the contact conducting portions 36, 36. These portions 37 are formed with a stepped portion therebetween. The rubber connector 38** is formed by a two-color molding method or the like.

Figure 9:
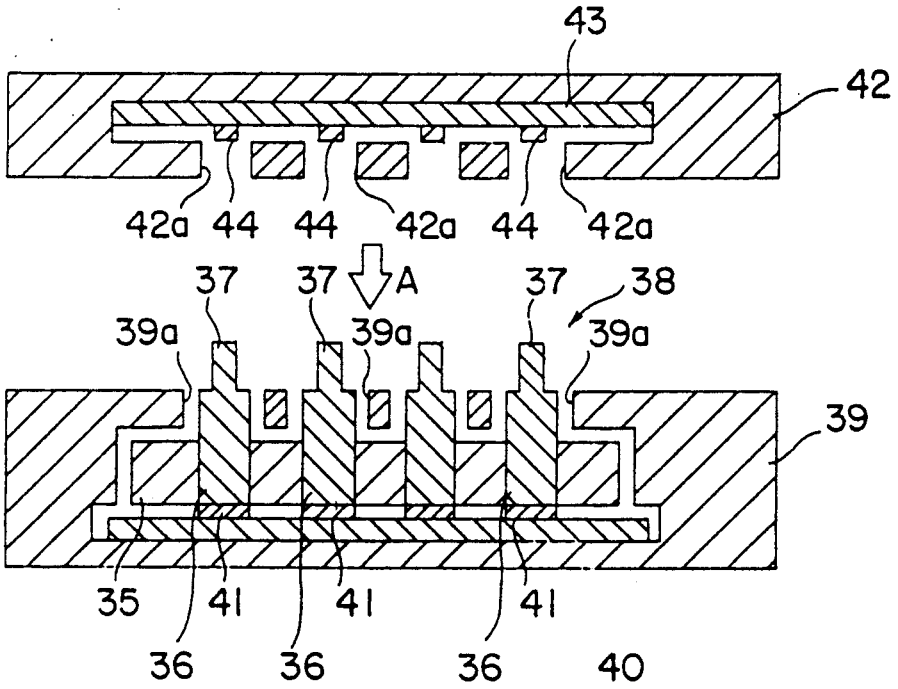
FIG. 9 is a vertical sectional view for explaining the manner in which two circuit boards are connected through the rubber connector of FIG. 8.

FIG. 9 is a vertical sectional view showing the manner in which two cabinets are connected with each other through the rubber connector 38 of FIG. 8, in which the smaller-diameter portions 37, 37, . . . at the front ends of the contact conducting portions 36, 36, . . . of the rubber connector 38 are passed through and projected from holes 39*a*, 39*a*, . . . made in the upper side of the cabinet 39 of the body of the computer (such as an IC reader). The bases of the contact conducting portions 36, 36, . . . are loaded in the cabinet 39 with their base ends held in contact with contact terminals 41, 41, . . . on the circuit board 40 contained in the cabinet 39. On the other hand, the underside of the cabinet 42 of the external memory (such as an memory card and IC card) containing the circuit board 43 to be connected is provided with holes 42*a*, 42*a*, . . . made therein corresponding to the positions of contact terminals 44, 44, . . . of the circuit board 43. As indicated by arrow A, the cabinet 42 of the external memory is pressed against and fixed to the upper side of the cabinet 39 of the body of the computer such that the smaller-diameter portions 37, 37, . . . of the rubber connector 38 are fitted into the holes 42*a*, 42*a*, . . . . The front ends of the smaller-diameter portions 37, 37, . . . are thereby brought into tight contact with the contact terminals 44, 44, . . . so that both the circuit boards 40 and 43 are electrically connected with each other.

The action of the rubber connector 38 of the above described structure will be described below.

When, as indicated by the arrow A in FIG. 9, the cabinet 42 of the external memory is pressed against and fixed to the upper side of the cabinet 39 of the body of the computer loaded with the rubber connector 38, the smaller-diameter portions 37, 37, . . . are only small portions projecting from the cabinet 39 of the body of the computer, i.e., approximately an upper half of the projecting portions of the contact conducting portions 36, 36, . . . projecting from the insulating portion 35 whereas the bases are made into larger-diameter portions which are twice as large as that. As a result, when the portions 37, 37, . . . are pressed against the contact terminals 44, 44, . . . , these portions 37, 37, . . . will be firmly supported by the larger-diameter portions to be applied with uniform stress. Hence, they will never be folded or produce any other irregular deformation or bring about imperfect contact. Because of the lack of irregular deformation, material deterioration or breakage due to fatigue is hardly produced even if the portions are subjected to repeated compressive stress by repeated engagement and disengagement between the cabinets 42 and 39. Accordingly, they can stand long use. Further, since holes 39*a* and 42*a* at the contacting portions of both the cabinets 39 and 42 are provided instead of openings extending over the total width, the strength of the cabinets are improved and dust is prevented from entry resulting in an improvement in reliability of the arrangement.

Although, in the above described embodiment, the contact conducting portions 36 were described to be of a cylindrical form, they may be arranged so as to be alternated with the insulating portions as shown in FIG. 4 and provided at the front ends thereof with portions of smaller width projecting therefrom forming a stepped portion thereat.

As apparent from the above description, the structure of the rubber connector of the present invention comprising contact conducting portions made of a rubber insulated by insulating portions and having projecting portions of the contact conducting portions projected from one side of the insulating portions is provided with smaller diameter stepped formed portions at the front ends of the projecting portions. Therefore, when both the cabinets are fixed to each other with the circuit boards of each having the rubber connector interposed therebetween and having the contact terminals of both the circuit boards pressed against the contact conducting portions, both the circuit boards are electrically connected with each other. The smaller diameter portions of the contact conducting portions projecting from one of the cabinet are not irregularly deformed because they are not of a slender form as are those in the conventional case. Thus, imperfect contact is eliminated, durability against repeated compression due to repeated engagement and disengagement between the cabinets is improved, and because external openings over the total width for providing the contacting portions of both the cabinets with openings are avoided improvement in the strength of the cabinets and of reliability on the arrangement can be achieved.

Figure 10:
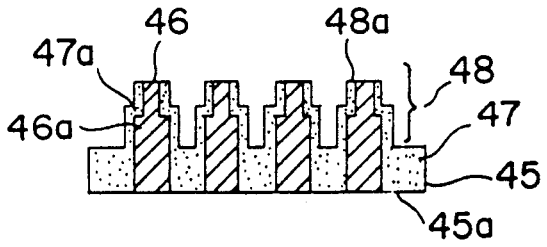
FIG. 10 is a constructional drawing of a rubber connector according to a fourth embodiment of the present invention.

Now, a fourth embodiment of the present invention will be described. FIG. 10 is a structural drawing in section of a rubber connector according to the fourth embodiment of the invention.

Referring to the figure, 45 denotes the connector body and this connector body 45 is of the structure in which the conducting portions 46 and insulating portions 47 are alternately disposed.

As illustrated, the rubber connector of the present embodiment has the projecting portions 48 formed on one side of the connector body 45.

The projecting portions 48 are made up of conducting portions 46*a* extending from their front end faces 48*a* and insulating portions 47*a* covering the peripheral faces of the stretched conducting portions 46*a*. These conducting portions 46*a* are stretched outwardly from the connector body 45 during the formation thereof.

Therefore, the connector 45 will electrically connect contact terminals (not shown) in abutment with the conducting portions 46*a* exposed to the outside on the front end faces 48*a* of the projecting portions 48 with contact terminals (not shown) in abutment with the conducting portions 46 exposed to the outside on the other face 45*a* of the connector body 45.

The stretched portion 46*a* of the conducting portion 46 is formed such that its lower portion within the projecting portion 48 is larger in width than its upper portion within the projecting portion 48, and thus, the projecting portion 48 is shaped in a two-step form.

The stretched portions 46*a* of the conducting portions 46 are covered by the insulating portions 47*a* at the time of molding. Therefore, the conducting portions 46 are only exposed to the outside on the faces in contact with the contact terminals and are not exposed on the peripheral faces 46*a* of the stretched portions. Hence, when the connector body 45 is used for connecting units together, the risk of leakage or the like between the same and the external memory, data processing unit, or the like using metallic material at their cabinet portions is eliminated and perfect contact is obtained.

A fifth embodiment of the present invention will be described below.

Figure 11:
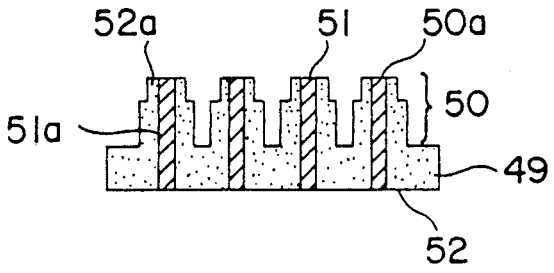
FIG. 11 is a constructional drawing of a rubber connector according to a fifth embodiment of the present invention.

The embodiment shown in FIG. 11 is the same as the preceding embodiment in that the projecting portions 50 are provided for the rubber connector body 49 but different in that the projecting portions 50 are made up of, conducting portions 51. Each conducting portion 51 is in the form of a rod extended to its front end face 50*a* and insulating portions 52 disposed between the conducting portions 51. The two-step form of each projecting portion 50 is provided by the insulating portion 52*a* covering the peripheral face of the stretched portion 51*a* of the conducting portion 51. That is, the insulating portion 52*a* is formed larger in width at its lower portion than at its upper portion. The connector of the present embodiment can be manufactured by a two-color molding method or various other manufacturing methods.

Since, in the present emodiment, the conducting portion 51 is in the form of a rod and is not provided with a two-step form, the quantity of material used therefor can be reduced. Therefore, cost reduction is achieved.

Figure 12:
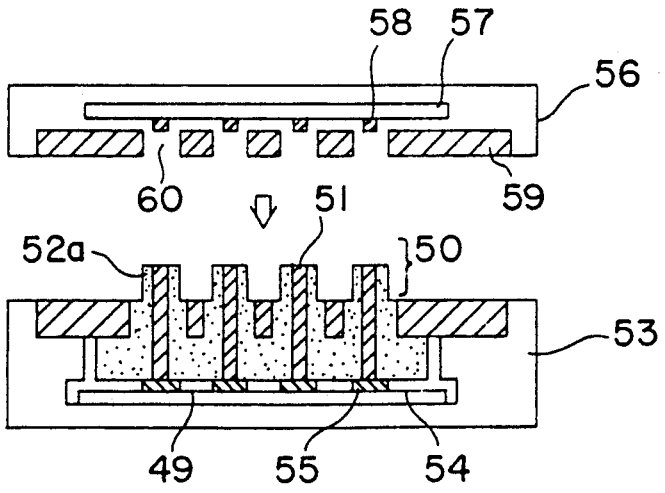
FIG. 12 is a drawing showing the condition of a unit fitted with the rubber connector of FIG. 11 to be connected with an external device.

In FIG. 12, a condition of a unit loaded with the rubber connector body 49 about to be connected is shown.

Referring to the figure, 49 corresponds to the aforesaid connector body, whereby contact terminals 55 on a circuit board 54 incorporated in a data processing unit (such as an IC card reader/writer) 53 with the rubber connector 49 fitted thereto are electrically connected with contact terminals 58 on a circuit board 57 incorporated in an external memory (such as an IC card) 56. Incidentally, a metal plate 59 is attached to one side of the external memory 56 and, when the connection is made, it is adapted such that the projecting portions 50 of the connector body 49 are inserted into through holes 60 made in the metal plate 59. Since the peripheral faces of the projecting portions 50 are covered by the insulating portions 52*a*, the conducting portions 51 and the metal plate 59 are electrically insulated.

According to the fourth and fifth embodiments as described above, the rubber connector in which the conducting portions and insulating portions are alternately disposed with each other is provided with the projecting portions formed on one side of the connector body, and each projecting portion is made up of the conducting portion stretched up to its front end face and the insulating portion covering the peripheral face of the stretched conducting portion with the conducting portion exposed to the outside on the front end face of the projecting portion. By virtue of such structure, the following effects are obtained:

(1) Imperfect contact or other trouble due to irregular deformation or the like of the contact conducting portions at the time they are compressed can be eliminated;

(2) Insulation between metallic portions of a cabinet on the exterior of equipment and the conducting portions of the rubber connector can be maintained; and (3) The projecting portions from the rubber connector can be tightly engaged with the connected portion of the equipment, and therefore, the degree of sealing under the connected condition can be improved and adverse effect from the outside can be reduced.

Thus, the connector of the present invention can be used for connecting a computer (such as an IC card reader) with an external memory circuit (such as an IC card and memory card).

While only certain embodiments of the present invention have been described, it will be apparent to those skilled in the art that various changes and modifications may be made therein without departing from the spirit and scope of the present invention as claimed.

What is claimed is:

1. A rubber connector comprising:

a plurality of insulating portions;

a plurality of conducting portions disposed alternately with said insulting portions and projected from adjacent insulating portions, said insulating portions and conducting portions being formed from the same element to make an integral, one-piece rubber connector; and at least one protrusion positioned on at least one of the insulating portions, said at least one protrusion aiding in positioning of the rubber connector on a circuit board.

2. The rubber connector according to claim 1, wherein said plurality of conducting portions are projected from said insulating portions in a predetermined direction.

3. The rubber connector according to claim 1, wherein each of said projecting conducting portions is provided at its front end with a smaller-diameter portion having a diameter smaller than the base portion for forming a stepped portion thereat.

* * * * *